US007934620B2

(12) United States Patent
Stribling et al.

(10) Patent No.: US 7,934,620 B2
(45) Date of Patent: May 3, 2011

(54) LEAKAGE PROTECTION

(75) Inventors: Robert Patton Stribling, Monroe, GA (US); Samuel Clifford Crosby, Lilburn, GA (US)

(73) Assignee: The Last Straw, LLC, Monroe, GA (US)

( * ) Notice: Subject to any disclaimer, the term of this patent is extended or adjusted under 35 U.S.C. 154(b) by 963 days.

(21) Appl. No.: 10/905,550

(22) Filed: Jan. 10, 2005

(65) Prior Publication Data

US 2005/0150894 A1 Jul. 14, 2005

Related U.S. Application Data

(60) Provisional application No. 60/534,982, filed on Jan. 9, 2004.

(51) Int. Cl.
*A47G 19/22* (2006.01)
*B65D 25/40* (2006.01)

(52) U.S. Cl. ..... 220/705; 220/229; 220/714

(58) Field of Classification Search ..... 220/705, 220/203.11, 203.17, 229, 709, 714, 719
See application file for complete search history.

(56) References Cited

U.S. PATENT DOCUMENTS

| | | | | |
|---|---|---|---|---|
| 4,809,679 | A * | 3/1989 | Shimonaka et al. | 600/154 |
| 5,054,631 | A | 10/1991 | Robbins, III | |
| 5,113,900 | A | 5/1992 | Gilbert | |
| 5,147,305 | A * | 9/1992 | Nakamura et al. | 604/110 |
| 5,184,774 | A | 2/1993 | Lipson | |
| 5,730,336 | A | 3/1998 | Lerner | |
| 5,868,701 | A * | 2/1999 | Powers, Jr. | 604/500 |
| 5,911,406 | A * | 6/1999 | Winefordner et al. | 251/339 |
| 6,039,305 | A | 3/2000 | Hoskins et al. | |
| 6,135,311 | A | 10/2000 | Panec | |
| 6,273,128 | B1 * | 8/2001 | Paczonay | 137/512.3 |
| 2002/0092858 | A1 * | 7/2002 | Bowman | 220/709 |
| 2002/0115961 | A1 | 8/2002 | Writt, Sr. | |
| 2003/0029503 | A1 * | 2/2003 | Williamson et al. | 137/510 |
| 2003/0037820 | A1 * | 2/2003 | Williamson et al. | 137/510 |
| 2003/0071136 | A1 * | 4/2003 | Ference | 239/33 |
| 2003/0173536 | A1 * | 9/2003 | Christensen et al. | 251/342 |
| 2003/0222238 | A1 | 12/2003 | Getzewich et al. | |
| 2004/0217187 | A1 * | 11/2004 | Renz et al. | 239/33 |
| 2004/0232375 | A1 * | 11/2004 | Steckel | 251/342 |
| 2005/0062009 | A1 * | 3/2005 | Hoskins | 251/342 |
| 2005/0145636 | A1 * | 7/2005 | Albright et al. | 220/714 |
| 2005/0242130 | A1 * | 11/2005 | Yang | 222/490 |
| 2006/0255169 | A1 * | 11/2006 | Gieson | 239/33 |

FOREIGN PATENT DOCUMENTS

| | | |
|---|---|---|
| EP | 0 266 067 | 5/1988 |

(Continued)

*Primary Examiner* — Anthony Stashick
*Assistant Examiner* — Niki M Eloshway
(74) *Attorney, Agent, or Firm* — Cantor Colburn LLP

(57) ABSTRACT

A flexible check valve is introduced within a fluid path for leakage protection. The flexible check valve can be a duckbill/crossbill valve comprising multiple flexible members that restrict the flow of fluid in a tubular member. The flexible check valve is preferably used in conjunction with a drinking straw to prevent liquid from exiting a container such as a drink box. Preferably, the flexible check valve is a crossbill valve that is attached using an adapter. Liquid is designed to only flow through when an external compressive force (e.g. users fingers or lips) is applied to the valve. When force is no longer applied to the valve section, the valve returns to its normally closed position and fluid is wholly or substantially prevented from exiting.

36 Claims, 11 Drawing Sheets

FOREIGN PATENT DOCUMENTS

| | | |
|---|---|---|
| EP | 0266067 | 5/1988 |
| GB | 705354 | 3/1954 |
| WO | WO 95/13786 | 5/1995 |
| WO | 2005070253 | 4/2005 |

* cited by examiner

Figure 4a
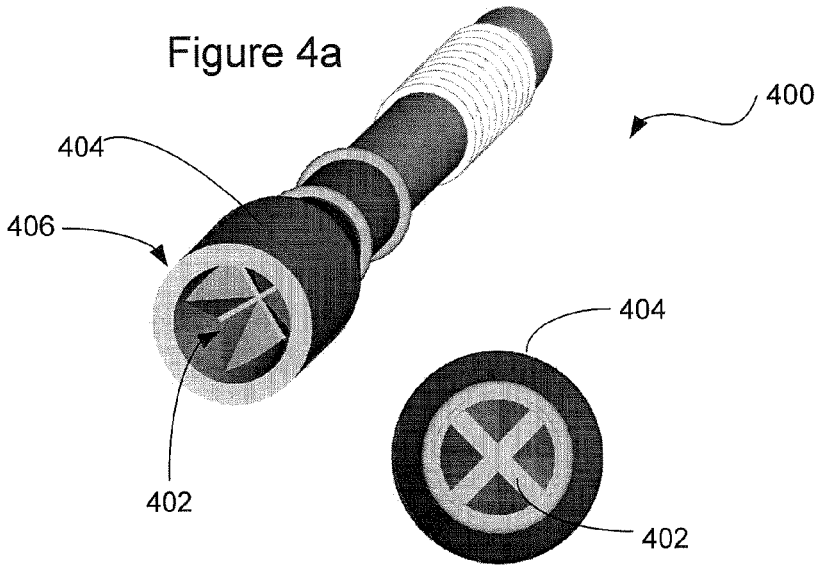
Figure 4b
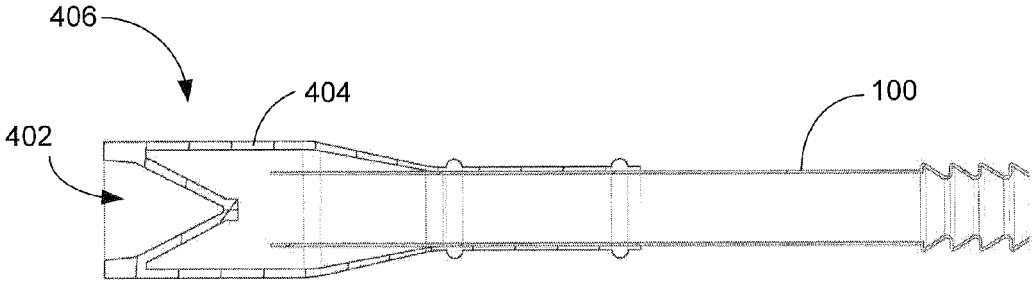
Figure 4c
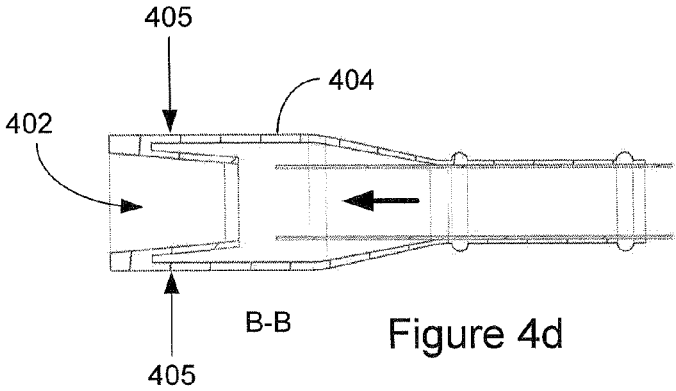
Figure 4d
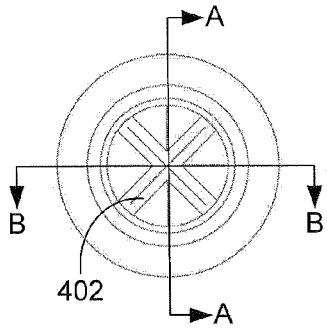
Figure 4e

LEAKAGE PROTECTION

RELATED APPLICATIONS

The present application claims the benefit of provisional patent application "Duck Bill Valve for Drinking Straw", Ser. No. 60/534,982, filed Jan. 9, 2004.

BACKGROUND OF THE INVENTION

The present invention is related to fluid flow control and more specifically leakage protection in a straw application.

DISCUSSION OF PRIOR ART

Juice boxes and pouches are well known sealed drinking containers. Typically, these containers have attached a plastic sealed straw, which is removed and used to puncture and drain the liquid within. These containers are predominantly used by children, who through various means enable liquid to escape the straw during non-drinking situations. One problem associated with the straws is the forced evacuation of liquid through squeezing of the container or by vacuum related capillary action. Tipping of the container may also cause liquid spills. The present invention reduces or eliminates the unwanted draining of the container.

Whatever the precise merits, features, and advantages of the prior art, it does not achieve or fulfill the purposes of the present invention.

SUMMARY OF THE INVENTION

The present invention uses a valve within a fluid path for leakage protection. The valve is preferably a flexible check valve such as a duckbill or crossbill. The valve comprises two or more flexible members that restrict the flow of liquid from a container during non-drinking situations. The flexible members of the valve limit pressurized flow and substantially prevent liquid from exiting while remaining normally closed. To open a valve section, external compressive force is applied (e.g., by a user's fingers or lips) which separates the flexible members allowing liquid to flow through. When external compressive force is no longer applied to the valve section, the valve returns to its normally closed position and fluid is prevented from exiting. Pressurized forces, such as liquid trying to escape through the straw when a user squeezes the drinking container, only serve to press the flexible members together with greater force.

The flexible check valve is preferably used within a tubular section having a fluid path and is attached to the exit end of the straw. An alternative embodiment includes the flexible check valve used entirely within the drinking straw. Preferably, the flexible check valve is a crossbill valve that is attached using an adapter. The attachment and flexible members of the valve may comprise several embodiments.

BRIEF DESCRIPTION OF THE DRAWINGS

FIG. 4*a* illustrates a perspective view of a crossbill valve.

FIG. 4*b* illustrates an internal rear view of the crossbill valve of FIG. 4.

FIG. 4*c* illustrates section A-A of FIG. 4*e*, which is a cutaway or sectional side view of the crossbill valve of FIG. 4*a*.

FIG. 4*d* illustrates section B-B of FIG. 4*e*, which is a cutaway or sectional top (or bottom) view of FIG. 4*a*.

FIG. 4*e* illustrates an end view of the crossbill valve of FIG. 4*a*.

DESCRIPTION OF THE PREFERRED EMBODIMENTS

Figure 1:
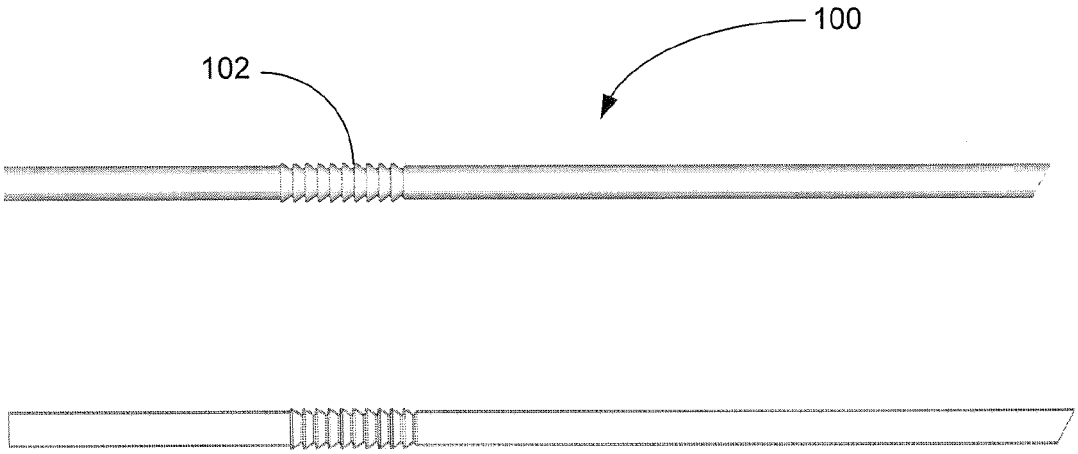
FIG. 1 illustrates an existing straw for a drink product.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention. In the description below it should be noted that the term "fluid" should include any type of liquid, gas, powder, particulate, gel, or colloid. Also, the attachment methods shown in the preferred embodiment can be used with other flexible check valves without departing from the scope of the invention.

FIG. 1 illustrates an existing drinking straw 100 for a drink container or product, such as a drink box or drink pouch. Straw 100 includes flexible section 102 for bending the straw end to ease drinking. The straw typically is 6.02 inches long, 0.180 inches wide, has a wall thickness of 0.007 inches, and has an outer diameter of 0.0168 inches. Also, the straw may have a tensile strength of 5700 psi, a cross sectional area of 0.0038 square inches, and a tensile limit of 21.7 pounds.

Figure 2A:
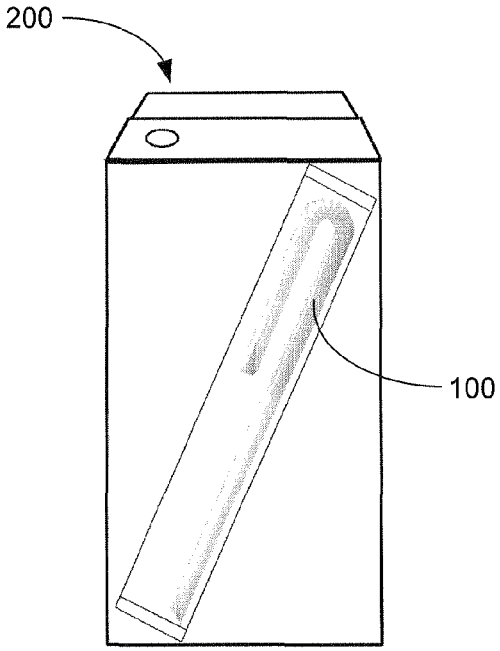
FIG. 2*a* illustrates the packaging of the straw from FIG. 1 before use (i.e. attached to outside of product).
Figure 2B:
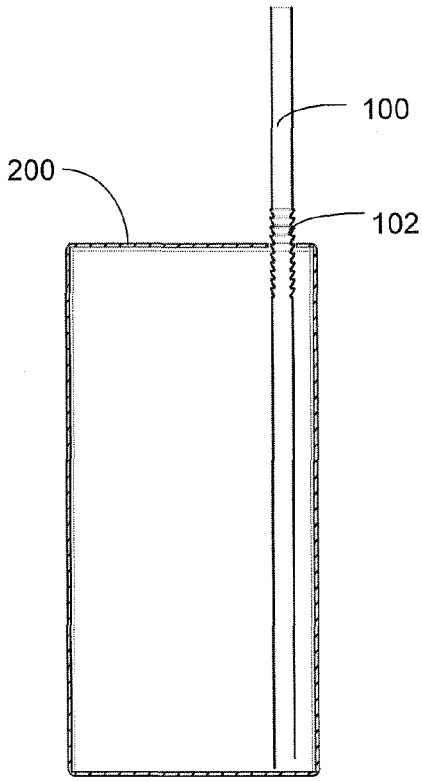
FIG. 2*b* illustrates the use of the straw from FIG. 1 when inserted into a drink product.

FIG. 2*a* illustrates an example of packaging of existing drinking straw 100 with juice box 200. The box may have, for example, a length of 4.20 inches. To accommodate the length of the juice box, straw 100 is bent during packaging. FIG. 2*b* illustrates the use of straw 100 in juice box 200. Typically, straw 100 is punched through box 200 to access the juice (or drinking fluid) within.

Figure 3:
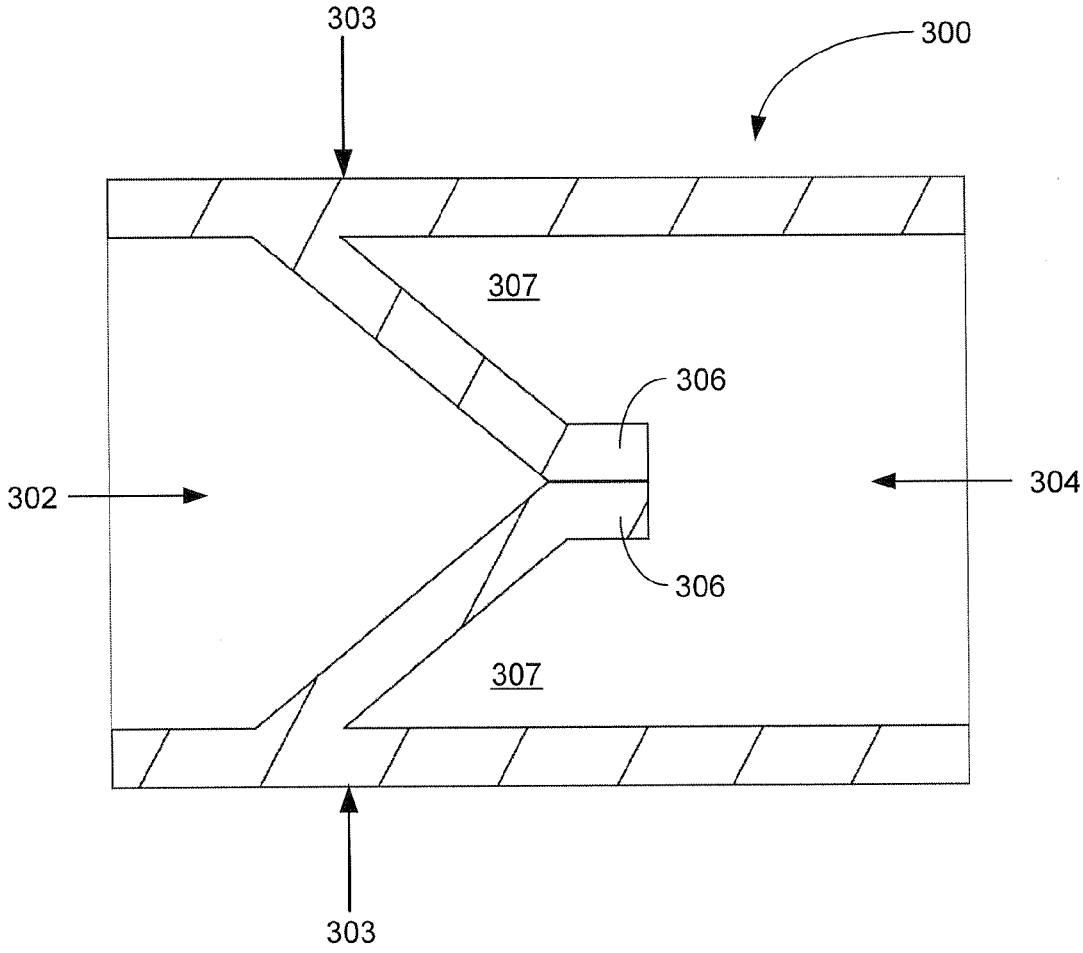
FIG. 3 illustrates a cutaway or section of a duckbill check valve used in the present invention.

Illustrated in FIG. 3 is an example of a cutaway or section of a flexible "duckbill" check valve 300. Duckbill valve 300 is a "one-way" valve typically of one-piece construction. Valve 300 comprises two flexible members 306 that resemble a "duckbill"; however, any sort, shape, number, material or variation of flaps or lips may be used. Flexible members 306 are used to form a check or mouth portion 302 and flow portion 304. Flexible members 306 are preferably made of elastomeric material, and are used to prevent reverse flow or leakage. It should be noted, however, that the valve body may be made of any material, and that flexible members may be made of any material that allows for movement of the flexible members, preferably by way of finger or lip or mouth pressure.

Valve 300 may be used for leakage prevention for a tubular section having a fluid path. The valve is used to prevent fluid that is in a pressurized state (such as from squeezing, capillary action, or tipping) from exiting a container. In order to reduce or eliminate the unwanted draining of the container, one present invention embodiment utilizes a duckbill valve as shown in the example in FIG. 300 in conjunction with a straw. Since a duckbill valve is normally closed, it is advantageous when used with liquids such as juice or drink. Flexible check valves (e.g. duckbill) may be opened by minimal action by a consumer (e.g., circumferentially compressing the valve with mouth, fingers, teeth, or lips), and return to a closed position when the action ceases. In other words, the user pinches the tubular surface in close proximity to the internally encapsulated valve. Referring back to FIG. 3, when compressive force 303 is applied to the valve, flexible members 306 separate, thus allowing flow from 304 to pass through the opening. However, when the compressive force is not applied (non-drinking situation) and a user applies a pressurized force (e.g. squeezing the juice container) the fluid flows into the cavities 307 applying pressure to flexible members 306, thereby strengthening the seal or check 302 of the valve and wholly or substantially preventing the exit of the fluid therethrough.

FIGS. 4*a* through 4*e* and 5*a* through 5*e* illustrate embodiments of the present invention of flexible check valves that may be attached to an existing straw; however, the straw may also be formed as a single structure with the valve as an internal part of the straw structure. The figures illustrate the valve in further detail. However, in general, the exiting end (distal) of the straw comprises at least a mouth portion, flexible check valve, a side or pressure point, and a connection section. The flexible check valve is preferably located on the inside of the mouth portion and comprises two or more flexible members that resemble a "duck bill" valve; however, any sort, shape, number, material or variation of flaps or lips may be used. For example, FIGS. 4*a* and 4*b* illustrate a perspective and internal rear view of a crossbill valve 400 that may be used with existing drinking straw 100. FIG. 4*c*-4*e* illustrates a cutaway or sectional side view, cutaway top (or bottom) view, and end view of crossbill valve tubular structure 400. FIG. 4*c* illustrates section A-A of FIG. 4*e*. FIG. 4*d* illustrates section B-B of FIG. 4*d*. Section B-B illustrates a top or bottom sectional view of valve 400. Duckbill valve 400 comprises mouth portion 406 with cross angled members 402 and circumferential side 404. In general, valve 400 is larger in diameter than straw 100; however, equal diameters would not depart from the scope of the present invention. As shown in the figures, valve 400 remains normally closed.

In order to use the straw, a user applies a compressive force 405 to side 404, such as by using their mouth (or lips or fingers or teeth) over the mouth portion 406 to distort the connection of cross angled members 402 of valve 400. Cross angled members 402 then open to allow liquid to come through the space between them. When force or pressure are no longer applied to side 404, valve 400 returns to its normally closed position and liquid is wholly or substantially prevented from exiting the container. One benefit to selecting the preferred crossbill embodiment (FIGS. 4*a*-4*e*), is that during use or during manufacturing no orientation step is required when connecting the valve to the straw. That is, the user may place pressure on almost any area of circumferential side 404 without concern for the orientation of the internal check valve (omni directional).

Figure 5B:
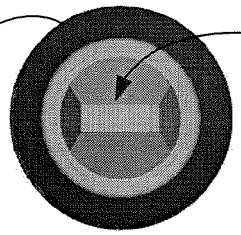
FIG. 5*b* illustrates an internal rear view of the single duckbill valve of FIG. 5*a*.
Figure 5A:
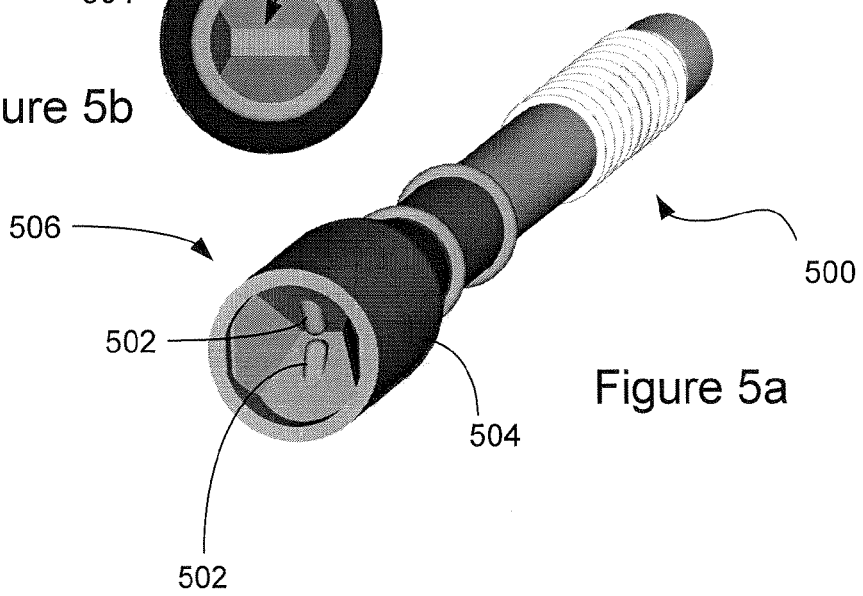
FIG. 5*a* illustrates a perspective view of a single duckbill valve.
Figure 5C:
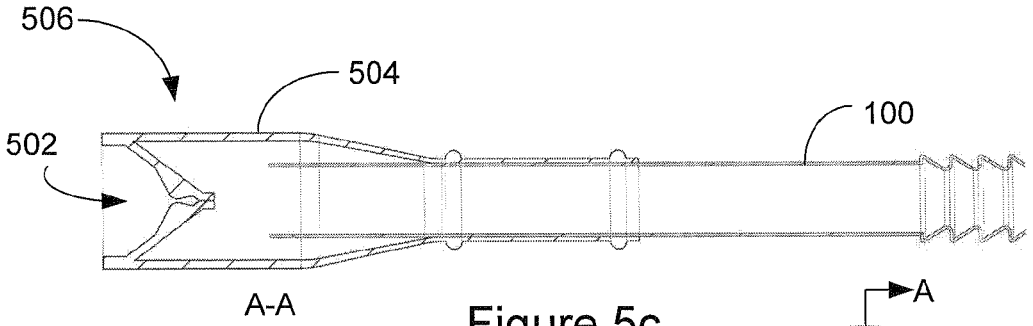
FIG. 5*c* illustrates section A-A of FIG. 5*e*, which is a cutaway or sectional side view of the crossbill valve of FIG. 5*a*.
Figure 5D:
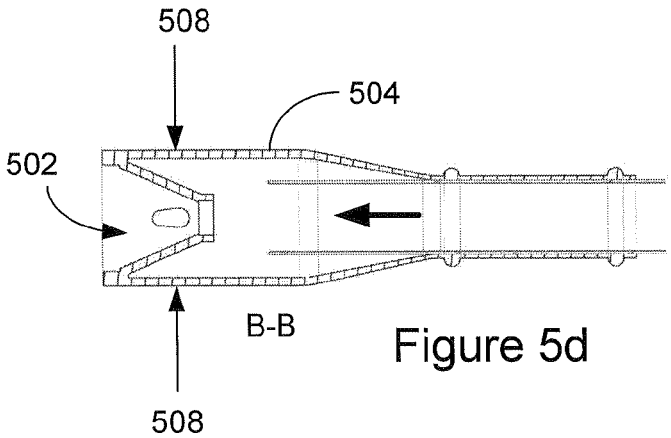
FIG. 5*d* illustrates section B-B of FIG. 5*e*, which is a cutaway or sectional top (or bottom) view of FIG. 5*a*.
Figure 5E:
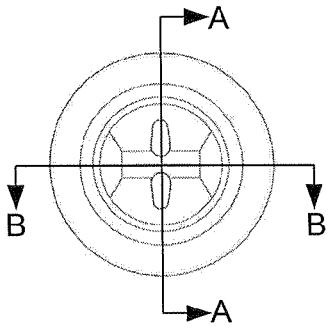
FIG. 5*e* illustrates an end view of the single duckbill valve of FIG. 5*a*.

Another embodiment of the flexible check valve of the present invention is shown in FIGS. 5*a*-5*e*. FIGS. 5*a* and 5*b* illustrate a perspective and internal rear view of single duckbill valve 500 used with existing drinking straw 100. FIGS. 5*c*-5*e* illustrate a cutaway or sectional side view, cutaway top view, and end view of single duckbill valve 500. FIG. 5*c* illustrates section A-A of FIG. 5*e*. FIG. 5*d* illustrates section B-B of FIG. 5*d*. Section B-B illustrates a top or bottom sectional view of valve 500. Duckbill valve 500 comprises a mouth portion 506 with lobe members 502 and circumferential side 504. Again, valve 500 is larger in diameter than straw 100; however, equal diameters would not depart from the scope of the present invention. Two lobe members 502 are formed in mouth portion 506. As shown in the figures, valve 500 remains normally closed. In order to use the straw, a user applies force to side 504, such as by using their mouth (or lips or fingers or teeth) over the mouth portion 506 compressing lobe members 502 of valve 500 and forcing valve to open. However, in this case, the orientation in which valve is applied to the straw must be considered in order to optimize performance. Pressure should be applied to the areas on circumferential side 504 in line with lobes 502, as represented by 508 and 510, to optimally open the valve. When force or pressure is properly applied, lobes 502 come together opening the valve to allow liquid to come through the space between them. When force is no longer applied to either side 504 at 508 and 510, valve 500 returns to its normally closed position and liquid is prevented from exiting the container. Therefore, during manufacturing, the attachment should consider the position of lobes 502 when attaching the valve to the straw.

In FIGS. 4*a*, 4*b*, 4*c*, 4*d*, 4*e*, and 5*a*, 5*b*, 5*c*, 5*d*, and 5*e*, the flexible check valve constructions are shown attached to existing straw 100. In general, the valves (for example, as described in FIGS. 4*a*, 4*b*, 5*a*, and 5*b*) may be attached to existing straws using any known method such as over molding, mechanical, shrink tube (heat shrink), friction fit, or adhesives.

Figure 6:
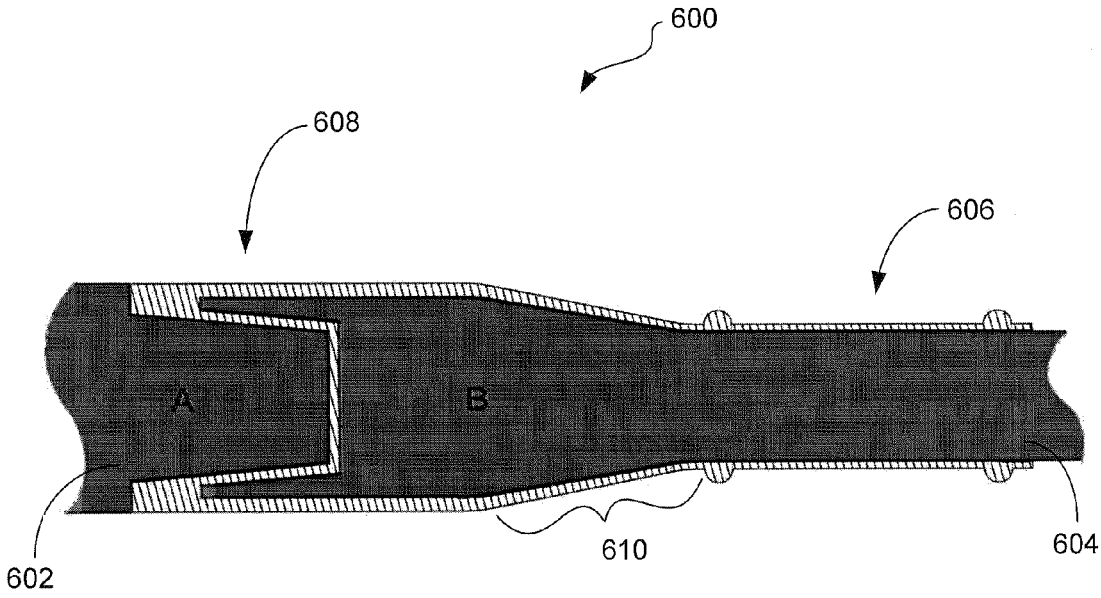
FIG. 6 illustrates the use of a core for manufacturing the duckbill valve.

FIG. 6 illustrates a cutaway or section of the use of a core for manufacturing the above described flexible check valves. Mold core A 602 and mold core B 604 are used to form duckbill valve 600 for a straw. As shown, the valve is compression set molded to create attachment area 606 for attachment to an existing straw and mouth portion 608 comprising a duckbill valve. However, some problems may occur with the method of forming and attaching the described duckbill valve. As previously mentioned, the duckbill valve member is generally larger in diameter than an existing straw. Therefore, when mold core B 604 is used to form valve 600, severe undercut 610 is formed. Undercut 610 may cause problems when retracting the core from the molded valve. For example, if the molded valve is not created from elastomeric material, the valve may have shape retention problems. The size of the valve (in comparison with the straw) can also create dimensional issues when attaching and forming the valve to the straw. In addition, the difference in valve and straw materials can create problems. Existing straws are formed of a plastic such as polypropylene. In a preferred embodiment, the duckbill valve is formed from elastomeric material(s), such as silicone. The material differences create problems with maintaining the attachment of the valve to the straw. Some attachment methods may cause problems with safety issues for children (e.g., choking).

Figure 7:
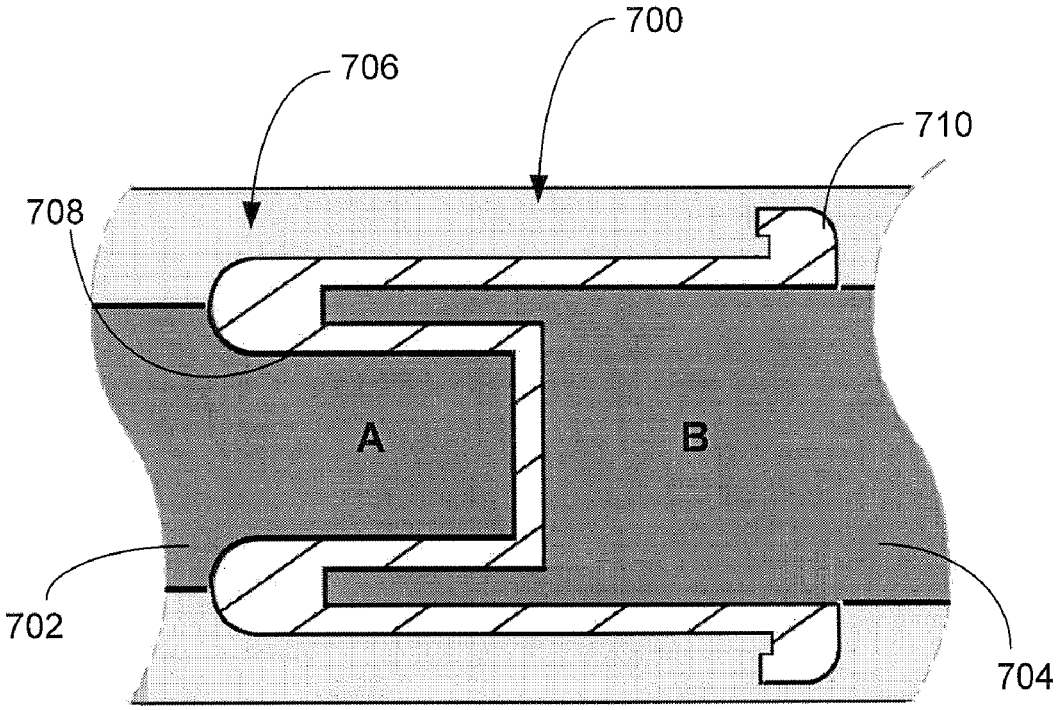
FIG. 7 illustrates a method of manufacturing the duckbill valve.

In order to address some of the above problems, FIG. 7 illustrates an alternative embodiment for manufacturing the duckbill valve. Valve 700 is formed from mold core A 702 and mold core B 704. With this method, the risk of distorting the valve or its previously mentioned retention problems is reduced. Further, the severe undercut created in FIG. 6 is removed and core retraction problems are eliminated. Valve 700 is shown as a cutaway or in section. Valve 700 comprises mouth portion 706 with flexible check valve 708 and lip portion 710. Lip portion 710 provides a mechanical attachment to the straw, as described further below.

Figure 8:
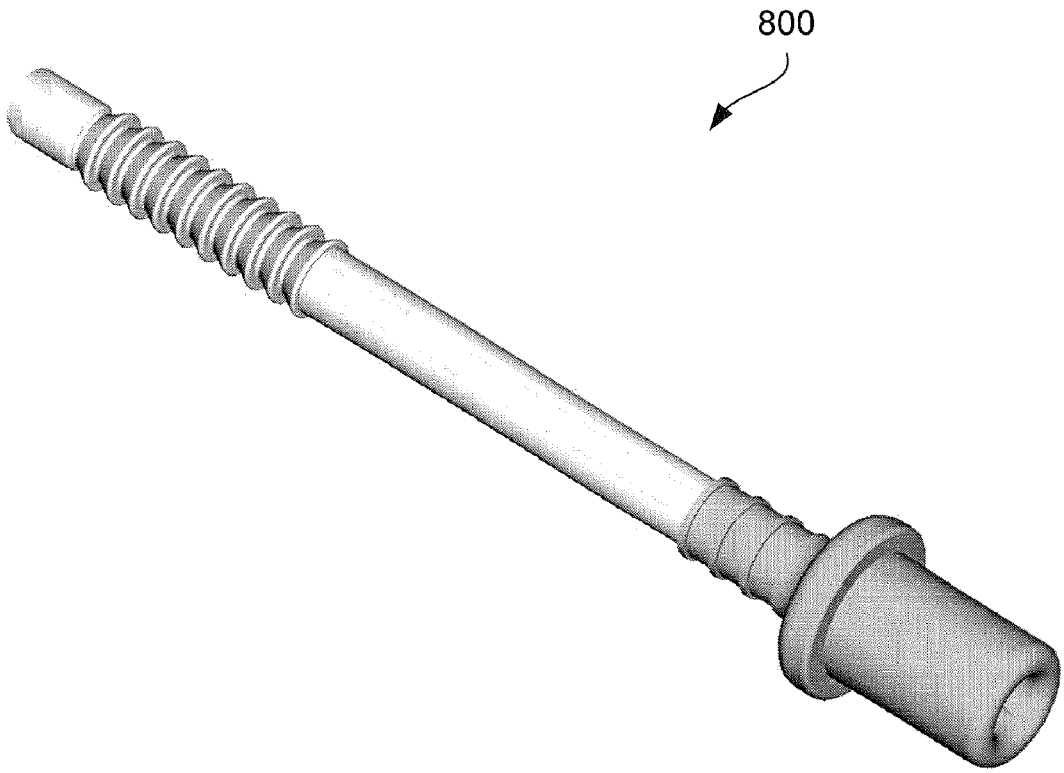
FIG. 8 illustrates the preferred embodiment of a drinking straw with a crossbill valve.
Figure 9:
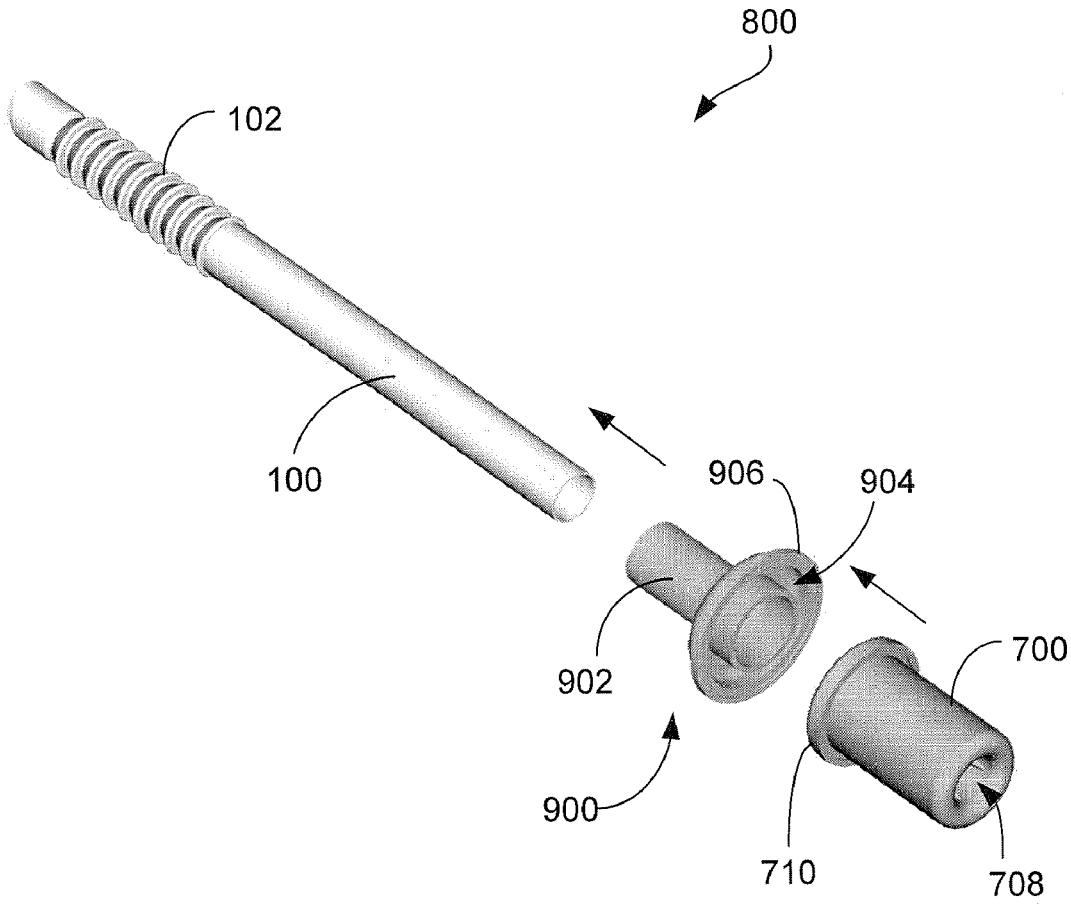
FIG. 9 illustrates the elements used to form the preferred embodiment straw of FIG. 8.

FIG. 8 illustrates the preferred embodiment of a ready-to-use combination drinking straw and flexible check valve. FIG. 9 illustrates the elements used to form the preferred embodiment straw of FIG. 8. Leakage prevention straw 800 comprises a drinking straw such as straw 100 (see FIG. 1), adapter 900, and a flexible check valve encapsulated within a tubular section 700 (as shown in FIG. 7). Preferably, straw 100 includes flex portion 102 and is made of a plastic material such as polypropylene. Also, in the preferred embodiment, valve 700 is a crossbill valve as shown in FIGS. 4*a*-4*e*.

In order to address the issues with material difference and methods of attachment, adapter 900 is provided as a transitional element from straw 100 to valve 700. Adapter 900 is a transition piece that comprises tubular portion 902, mating interface 904, and ends 906. In the preferred embodiment, adapter 900 comprises polypropylene material. Tubular portion 902 is designed to be large enough to fit over the outer diameter of straw 100. Mating interface 904 is designed to accept flexible check valve 700. Valve 700 comprises lip portion 710 which is designed to engage mating interface 904 of adapter. Valve 700 is preferably made of elastomeric material such as silicone. As described below, the design in FIGS. 8 and 9 allow for the mating of dissimilar materials (polypropylene and silicone).

Figure 10A:
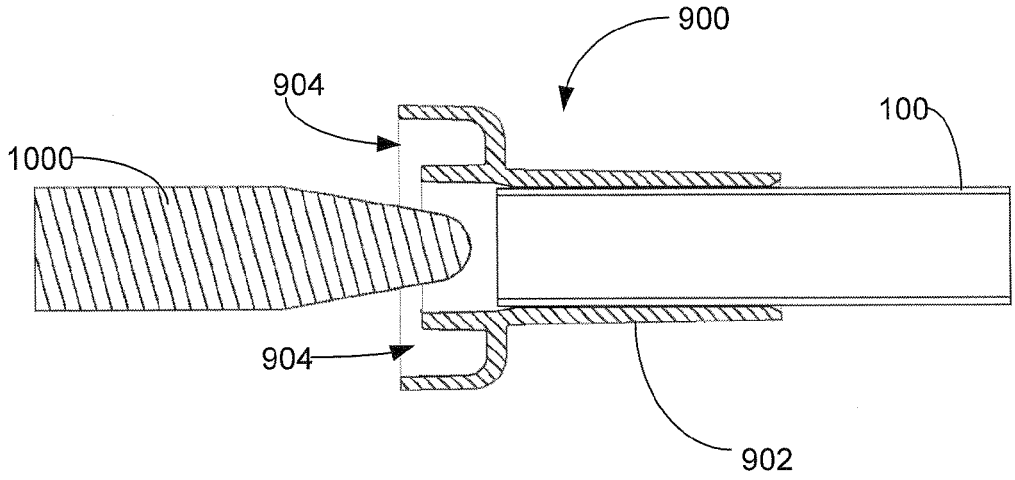
FIG. 10*a* illustrates a step for assembling a straw and adapter in the manufacturing of the preferred embodiment.
Figure 10B:
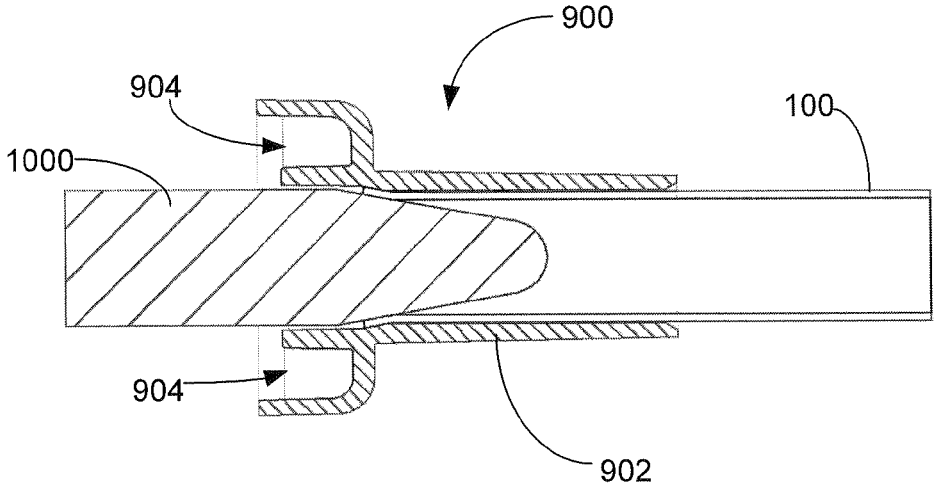
FIG. 10*b* illustrates a step for sonically welding a straw and adapter in the manufacturing of the preferred embodiment.

FIG. 10*a* illustrates a step for assembling straw 100 and adapter 900 for the manufacturing of the preferred embodiment. Tubular portion 902 of adapter 900 is placed over straw 100 using an anvil or rod 1000. Because tubular portion 902 preferably comprises a common or similar material as that of straw 100, positive bonding or welding may be utilized to attach adapter 900 to straw 100. As shown in FIG. 10*b*, once rod 1000 is in place, the ends of straw 100 are slightly bent to aid in the welding process. In the preferred embodiment, adapter 900 is sonically welded to straw 100 (for example, by vibrating at a high frequency). Mating interface 904 is left open to receive valve 700.

Figure 11A:
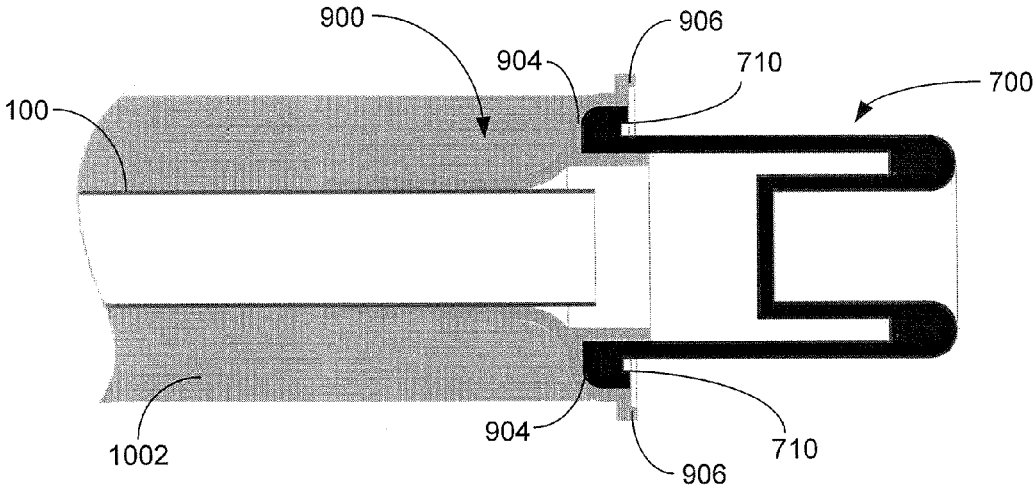
FIGS. 11*a* and 11*b* illustrate steps for mechanically attaching a crossbill valve to the straw and adapter in the manufacturing of the preferred embodiment.
Figure 11B:
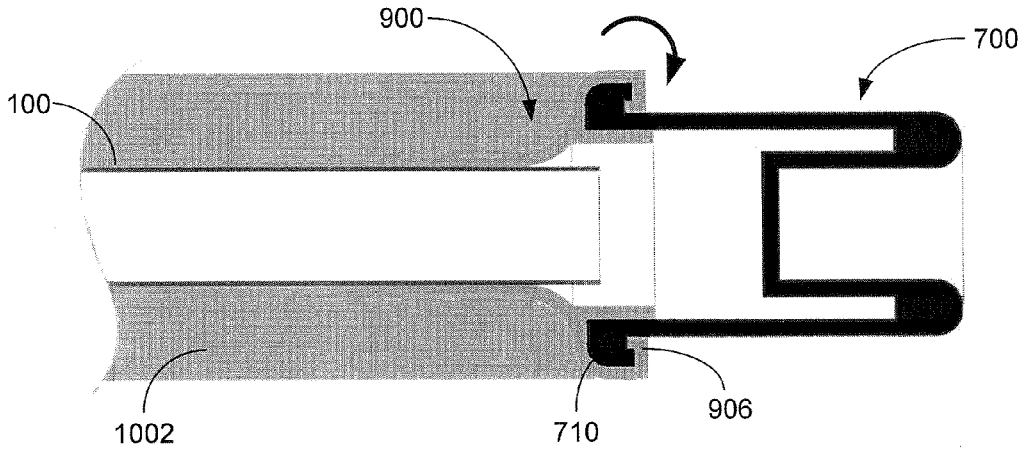

FIGS. 11*a* and 11*b* illustrate the steps for mechanically attaching flexible check valve 700 to the straw/adapter combination formed in FIG. 10. The straw/adapter combination is held by fixture 1002. Valve 700 is mechanically inserted into adapter 900. As shown, lip portion 710 is designed to fit within mating interface 904. Once inserted, adapter ends 906 are folded or formed over lip portion 710 to retain the flexible check valve. In the preferred embodiment, ends 906 and lip portion 710 are heat sealed for memory retention and to permanently lock straw 100, adapter 900, and valve 700 together to create leakage prevention straw 800.

CONCLUSION

A system and method has been shown in the above embodiments for the effective implementation of a valve for a drinking straw. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by size, materials, or specific manufacturing techniques.

In addition, the flexible check valve structure, manufacturing and attachment techniques can be used to prevent pressurized loss/retention of any liquid, gas, powder, particulate, gel, or colloid. The apparatus can be equally applied to non-juice container straws (e.g. other straws, baby bottle nipples, etc.) and be used in alternative fields such as medical. The completeness of leakage prevention may be based on the quality of materials, manufacturing techniques, attachment techniques, and pressures encountered. In any embodiment, the configuration should substantially prevent fluids from escaping past the flexible check valve and ideally provide a 100% check.

What is claimed is:

1. A fluid path leakage prevention apparatus comprising:

a tubular section comprised of a first material providing a fluid path;

a transition piece comprising a material which is positive bondable or weldable to the first material and having a proximate and distal end, the proximate end connected to the tubular section, the distal end having a mating interface and an adapter end; and a circumferentially actuated flexible check valve comprising silicone and having a lip portion at one end and a mouth portion comprising two or more flexible members at the other end, the check valve being connected to and extending outwardly from the distal end of the transition piece and operatively connected to the fluid path, the lip portion extending radially outwardly from the check valve and being sealably disposed within the mating interface of the transition piece, the adapter end encompassing the lip portion and permanently locking the lip portion in sealed engagement with the mating interface, wherein the circumferentially actuated flexible check valve substantially prevents removal of a pressurized fluid in the fluid path during a non-actuated period.

2. A fluid path leakage prevention apparatus, according to claim 1, wherein the fluid is any of: a liquid, a gas, a gel, a colloid, a powder, and a particulate.

3. A fluid path leakage prevention apparatus, according to claim 1, further comprising a drinking container operably connected to the tubular section, wherein the tubular section is a straw for removal of liquid from the drinking container.

4. A fluid path leakage prevention apparatus, according to claim 3, wherein the drinking container comprises a juice box.

5. A fluid path leakage prevention apparatus, according to claim 3, wherein the drinking container comprises a juice pouch.

6. A fluid path leakage prevention apparatus, the apparatus comprising:

a tubing comprising a first material and having an internal fluid path;

a transition piece comprising a material which is positive bondable or weldable to the first material and having a proximate and distal end, the proximate end connected to the tubular section, the distal end having a mating interface and an adapter end;

a flexible check valve comprising silicone and having a reverse crossbill configuration functionally connected to the fluid path; and a compressible valve actuation member comprising silicone and having a lip portion at one end and the flexible check valve at the other end, the actuation member circumferentially encapsulating the flexible check valve and being connected to and extending outwardly from the distal end of the transition piece, the lip portion extending radially outwardly from the actuation member and being sealably disposed within the mating interface of the transition piece, the adapter end encompassing the lip portion and permanently locking the lip portion in sealed engagement with the mating interface;

wherein the flexible check valve prevents leakage of a pressurized fluid through the fluid path during a non-actuated period.

7. A fluid path leakage prevention apparatus, according to claim 6, wherein the compressible valve actuation member is compressible by a force created by any of: a mouth, lips, teeth, or fingers of a user.

8. A drinking straw leakage prevention system, the system comprising:

a drinking straw with internal fluid path;

a flexible section of tubing or an additional tubing section operably connected to the straw;

a transition piece comprising polypropylene and having a proximate and distal end, the proximate end connected to the tubing section, the distal end having a mating interface and an adapter end;

a reversed flexible check valve comprising silicone, the check valve functionally connected to the internal fluid path; and a compressible valve actuation member comprising silicone and having a lip portion, the lip portion extending radially outwardly from the actuation member and being sealably disposed within the mating interface of the transition piece, the adapter end encompassing the lip portion and permanently locking the lip portion in sealed engagement with the mating interface, the actuation member encapsulating the check valve at a position distally from the lip portion, wherein the flexible check valve substantially prevents leakage of a pressurized fluid through the fluid path during a non-actuated period.

9. A drinking straw leakage prevention system, according to claim 8, wherein the reversed flexible check valve is encapsulated within the compressible valve actuation member in a reversed configuration.

10. A drinking straw leakage prevention system, according to claim 9, wherein the reversed flexible check valve is a duckbill valve or a crossbill valve.

11. A drinking straw leakage prevention system, according to claim 10, wherein the duckbill or crossbill valve further comprise lobes in at least two flaps thereof.

12. A drinking straw leakage prevention system, according to claim 8, wherein the reversed flexible check valve is normally closed.

13. A drinking straw leakage prevention system, according to claim 8, wherein the reversed flexible check valve is partially open.

14. A drinking straw leakage prevention system, according to claim 13, wherein the partially open reversed flexible check valve is obtained by removing a portion of an end of each flap of a duckbill valve.

15. A drinking straw leakage prevention system, according to claim 8, wherein the compressible valve actuation member comprises the flexible section oftubing circumferentially enclosing at least a portion of the reversed flexible check valve.

16. A drinking straw leakage prevention system, according to claim 15, wherein the compressible valve actuation member and circumferentially enclosed reversed flexible check valve are of a greater fluid path diameter than that of the drinking straw.

17. A drinking straw leakage prevention system, according to claim 15, wherein the reversed flexible check valve and compressible valve actuation member are integrally molded as a single piece.

18. A drinking straw leakage prevention system, according to claim 8, wherein the compressible valve actuation member is compressible by a force created by: a mouth, lips, teeth, or fingers of a user.

19. A drinking straw leakage prevention system, according to claim 8, wherein the reversed flexible check valve is functionally connected to the fluid path by the additional tubing section, comprising the reversed flexible check valve and compressible valve actuation member.

20. A drinking straw leakage prevention system, according to claim 19, wherein another transition piece is disposed between the drinking straw and the additional tubing section.

21. A drinking straw leakage prevention system, according to claim 20, wherein the another transition piece is connected to the drinking straw at the proximate end of the transition piece and the transition piece is attached to the additional tubing section at the distal end of the transition piece.

22. A drinking straw leakage prevention system, according to claim 21, wherein the transition piece is operatively connected to the drinking straw by a process that comprises sonic welding.

23. A drinking straw leakage prevention system, according to claim 21, wherein the transition piece is attached to the additional tubing by a process that comprises inserting a lip of the additional tubing section into a groove located in the distal end of the transition piece and folding a section of the transition piece at the distal end to encapsulate the lip and hardening the folded section.

24. A drinking straw leakage prevention system, according to claim 19, wherein the additional tubing section, comprising the reversed flexible check valve and compressible valve actuation member, is attached to the straw by a process that comprises welding, frictionally fitting, adhering, collaring, and heat shrinking.

25. A drinking straw leakage prevention system, according to claim 19, wherein the additional tubing section comprises at least one of an elastomeric material, a silicone, and a flexible plastic material.

26. A drinking straw leakage prevention system, according to claim 8, wherein the reversed flexible check valve is functionally connected to the fluid path integrating the reversed flexible check valve and compressible valve actuation member within the straw.

27. A packaging content removal prevention apparatus, the apparatus comprising:

a packaging;

tubing comprising a first material and operatively connected to the packaging, the tubing providing a conduit for removal of the content of the packaging;

a transition piece comprising a material which is positive bondable or weldable to the first material and having a proximate and distal end, the proximate end connected to the tubing, the distal end having a mating interface and an adapter end;

a reversed flexible check valve comprising silicone and being operative to prevent passage of the content through the conduit; and a compressible valve actuation member comprising silicone and having a lip portion, the actuation member circumferentially encapsulating the flexible check valve at a position distally from the lip portion, and the lip portion extending radially outwardly from the actuation member and being sealably disposed within the mating interface of the transition piece, the adapter end encompassing the lip portion and permanently locking the lip portion in sealed engagement with the mating interface, wherein the flexible check valve prevents removal of the content through the tubing during a non-actuated period in which the packaging receives compressive forces.

28. A packaging content removal prevention apparatus, according to claim 27, wherein the reversed flexible check valve comprises a duckbill valve or a crossbill valve.

29. A packaging content removal prevention apparatus, according to claim 27, wherein the reversed flexible check valve and compressible valve actuation member are integrally molded as a single piece.

30. A packaging content removal prevention apparatus, according to claim 27, wherein the packaging comprises a juice box or pouch.

31. A fluid path leakage prevention apparatus comprising:

a tubular section providing a fluid path, the tubular section having an entry and exit end;

a transition piece comprising polypropylene and having a proximate and distal end, the proximate end connected to the tubular section exit end, the distal end having a radially extending mating interface comprising an adapter end; and a circumferentially actuated valve section comprising silicone and having a lip portion at one end and a mouth portion comprising two or more flexible members at the other end, the valve section being connected to and extending outwardly from the distal end of the transition piece and operatively connected to the fluid path, the lip portion extending radially outwardly form the valve section and being sealably disposed within the mating interface of the transition piece, the adapter end encompassing the lip portion and permanently locking the lip portion in sealed engagement with the mating interface; and wherein the circumferentially actuated valve section substantially prevents leakage of a pressurized fluid past the circumferentially actuated valve section during a non-actuated period.

32. A fluid path leakage prevention apparatus, according to claim 31, wherein the fluid is any of: a liquid, a gas, a gel, a colloid, and a particulate.

33. A fluid path leakage prevention apparatus, according to claim 31, wherein the transition piece is bonded or welded to the tubular section.

34. A fluid path leakage prevention apparatus, according to claim 33, wherein the transition piece is bonded or welded to the tubular section by a process that comprises sonic welding.

35. A fluid path leakage prevention apparatus, according to claim 33, wherein the transition piece is attached to the circumferentially actuated valve section by a process that comprises inserting a lip of the circumferentially actuated valve section into a groove located in the distal end of the transition piece and folding a section of the distal end to encapsulate the lip and hardening the folded section.

36. A fluid path leakage prevention apparatus, according to claim 31, further comprising a drinking container operably connected to the tubular section, and wherein the tubular section providing a fluid path is a drinking straw providing the fluid path from a juice box or pouch to a user.

* * * * *